US005594968A

United States Patent [19]

Haselwander et al.

[11] Patent Number: 5,594,968

[45] Date of Patent: Jan. 21, 1997

[54] METHOD AND APPARATUS FOR SPACE DYEING YARN

[75] Inventors: Jack G. Haselwander, Chattanooga, Tenn.; Kurt W. Niederer, Charlotte, N.C.

[73] Assignee: Belmont Textile Machinery Company, Mt. Holly, N.C.

[21] Appl. No.: 506,077

[22] Filed: Jul. 24, 1995

[51] Int. Cl.[6] ..... D06B 1/14; D06B 11/00

[52] U.S. Cl. ..... 8/149; 68/203

[58] Field of Search ..... 8/149; 68/203; 101/172; 118/247

[56] References Cited

U.S. PATENT DOCUMENTS

| | | | |
|---|---|---|---|
| 1,930,986 | 10/1933 | Shaffner | 101/172 |
| 3,083,640 | 4/1963 | Milner | 101/172 |
| 3,541,958 | 11/1970 | Keown | 68/203 X |
| 3,871,196 | 3/1975 | Matsunaga | 68/203 |
| 5,339,658 | 8/1994 | Haselwander | 68/203 |

*Primary Examiner*—Philip R. Coe
*Attorney, Agent, or Firm*—Alan Ruderman

[57] ABSTRACT

A method and apparatus for space dyeing yarn includes a series of dye stations each of which has a dye applicator roll and a rotatable pattern roll having deflecting rods which may deflect yarn into engagement with the periphery of the respective dye applicator roll. Each pattern roll is rotatably driven by a servo motor and selectively rotated to position the deflecting rods for permitting dyeing to occur at the respective station and to rotate the roll and thus the rods to angular dispositions where the yarn is not deflected. A programmable controller controls the respective motors to the selected angular positions at precise times to start and stop the application of dye to the yarn. An encoder associated with the yarn feed system feeds timing signals related to yarn movement to the controller so that rotation of each pattern roll is in timed relationship with the movement of the yarn.

12 Claims, 4 Drawing Sheets

METHOD AND APPARATUS FOR SPACE DYEING YARN

BACKGROUND OF THE INVENTION

This invention relates to a method and apparatus for space dyeing yarn to obtain substantially random variations of dye along the length of yarn strands, and more particularly to a method and apparatus of applying dyes of different colors to moving yarn strands while varying the amount of each dye color applied to the yarn so that the length of each dye color or dye spot on the yarn and the location of the dye spots may be varied in accordance with selective substantially random patterns.

It is desirable and known to provide yarns which have a color pattern that varies along the length of the yarn strand. Such yarns, known as space dyed yarns, find utility in certain carpet having a multi-color effect. Ideally, the carpet has no visible pattern. However, the space dyeing apparatus of the prior art does not permit random pattern repeats, but repeats of finite lengths. Thus, when the yarn is tufted into a backing to form carpet, a chevron pattern, known as the moire-effect, seen as curved lines across the finished product may result.

In Haselwander U.S. Pat. Nos. 5,339,658; 5,386,606 and 5,386,712, the known prior art space dyeing systems are discussed and a system is disclosed wherein yarn strands are fed over support members above a series of dye applicator rolls rotatably disposed within respective dye pans, and a pattern roll is disposed above and offset from the respective applicator rolls, each pattern roll carrying a circumferential array of paddles which may be selectively positioned about the circumference to engage and deflect the yarn strands against the respective applicator rolls. All of the dye applicator rolls are driven by a first drive at a first speed, and all of the pattern rolls are driven by a second drive at a second speed. Although apparatus constructed in accordance with the teachings of the Haselwander patents provide good results, it has pattern repeat limitations. That is, the maximum length of a pattern repeat is limited. With apparatus having pattern rolls spaced apart at five inch centers, and a roll circumference of approximately one foot, the maximum pattern repeat is in the order of approximately 150 inches. After drying, this pattern repeat shrinks to approximately 137 inches. In another known space dyeing system, disks having a slotted sector are rotated above the moving yarn strands and a nozzle corresponding to each disk and spraying a dye of a different respective color onto the disk is provided, the dye pattern being dependent upon the size of the sector opening.

In each of these prior art situations, the relatively short pattern repeat may be unacceptable to the carpet stylist or designer for certain carpet stylings. Additionally, with such short pattern repeats, adjoining yarns may line up causing the undesirable chevron effect. Another limitation of the prior art is the lack of flexibility in producing different length dye spots. For example, since the pattern rolls, and apparently the rotating disks, are driven at fixed, albeit adjustable, speeds, the length of a dye spot of a particular color, i.e., the length of a particular color dye on the yarn, is fixed, and its location in the pattern repeat is also fixed. As aforesaid, such deficiencies of the prior art apparatus and methods present limitations to the carpet styles producable with such yarns.

SUMMARY OF THE INVENTION

Consequently, it is a primary object of the present invention to provide a method and apparatus for space dyeing yarn with a practically random pattern and practically unlimited pattern length or repeat.

It is another object of the present invention to provide a method and apparatus for space dyeing yarn with a substantially unlimited pattern repeat and with selected color spots or sections arranged in selectively varying sequences and lengths.

It is a further object of the present invention to provide a method and apparatus for space dyeing yarn wherein a moving yarn is fed through a number of dye stations having respective dye colors, each station having a rotatable pattern member permitting the respective dye color to be applied to the yarn at that station, and wherein the speed of rotation and thus the angle through which each pattern member is rotated is controllably varied so that the period of time during which dye is permitted by the respective pattern member to be applied to the yarn may be varied.

It is a still further object of the present invention to provide a method and apparatus for space dyeing yarn wherein a moving yarn is fed through a number of dye stations having respective dye colors, each station having a rotatable pattern member permitting the respective dye color to be applied to the yarn at that station, wherein the speed of rotation and thus the angle through which each pattern member is rotated is controllably varied so that the period of time during which dye is permitted by the respective pattern member to be applied to the yarn may be varied, and wherein the location along the yarn at which each dye member permits dye to be applied is coordinated so that each different color dye is applied to the yarn at selected locations.

Accordingly, the present invention provides a method and apparatus for space dyeing yarn with practically unlimited color patterns and pattern length. To this end there is provided a series of dye stations, each station having dye applying means to apply dye of a respective color to strands of yarn fed through the station, each dye station including a rotatable pattern control member which is selectively rotated so as to permit the respective dye to be applied to the yarn. Each pattern control member is rotatably driven by a motor that is controlled by a programmable controller which drives the respective motor to selected angular positions at precise times to start and stop the application of dye to the yarn, an encoder associated with the yarn feed system feeding timing signals relating to yarn movement through the stations back to the controller so that the rotation of each pattern control motor is coordinated with and in timed relationship with the movement of the yarns fed through the system.

Although the principles of the present invention may be applied to any dyeing system having a rotatable pattern control member associated with a respective dye dispensing or dye applying means, in the preferred form of the invention, the dyeing apparatus comprises apparatus constructed in accordance with the aforesaid Haselwander patents wherein the yarn is fed over support members above a series of dye pans within which dye applicator rolls rotate. In this case, each pattern control member comprises a rotatable pattern roll associated with the respective dye applicator roll and yarn deflecting paddles or rods at certain positions on the circumference for selectively engaging and deflecting the yarn against the respective dye applicator roll. Each dye applicator roll and dye pan together with the respective pattern roll comprises the respective dye station. Each pattern roll is driven by a respective servo drive and motor, the motors being angularly positioned by signals received from a controller which is programmed to drive each pattern roll servo to a specific angular position to start and stop the dyeing of the yarn by the respective pattern roll in timed relationship with movement of the yarn through the dye stations. The yarn is fed by a separate motor for driving the yarn through the system at a selected speed and a signal generating means, such as an encoder, associated with the yarn feed system feeds timing pulses back to the controller for providing the proper timing of signals to the individual servo motors.

The time and position signals programmed into the controller are determined by the geometry of the system including the number of stations, the number of paddles on the pattern roll, the acceleration characteristics of the pattern roll and paddle system, the selected yarn speed, the yarn characteristics such as coefficient of elongation and coefficient of friction, pan selection for each selected color, the pattern or array of colors including the length of the dye spot and location desired on the yarn, the wicking of each color and initial yarn tension. The specific time at which each pattern roll must be at an angular disposition for a paddle to engage and deflect the yarn against the respective dye applicator roll and must be at an angular disposition to cease engagement and deflection of the yarn against the dye applicator roll determines when each respective color starts and stops dyeing of the yarn at the respective station. If a short color spot is desired, a paddle engages the yarn for a short time and if a longer color spot is desired the paddle engages the yarn for a longer time, the time of engagement being related to the movement and angular position of the pattern wheel and the feeding speed of the yarn.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
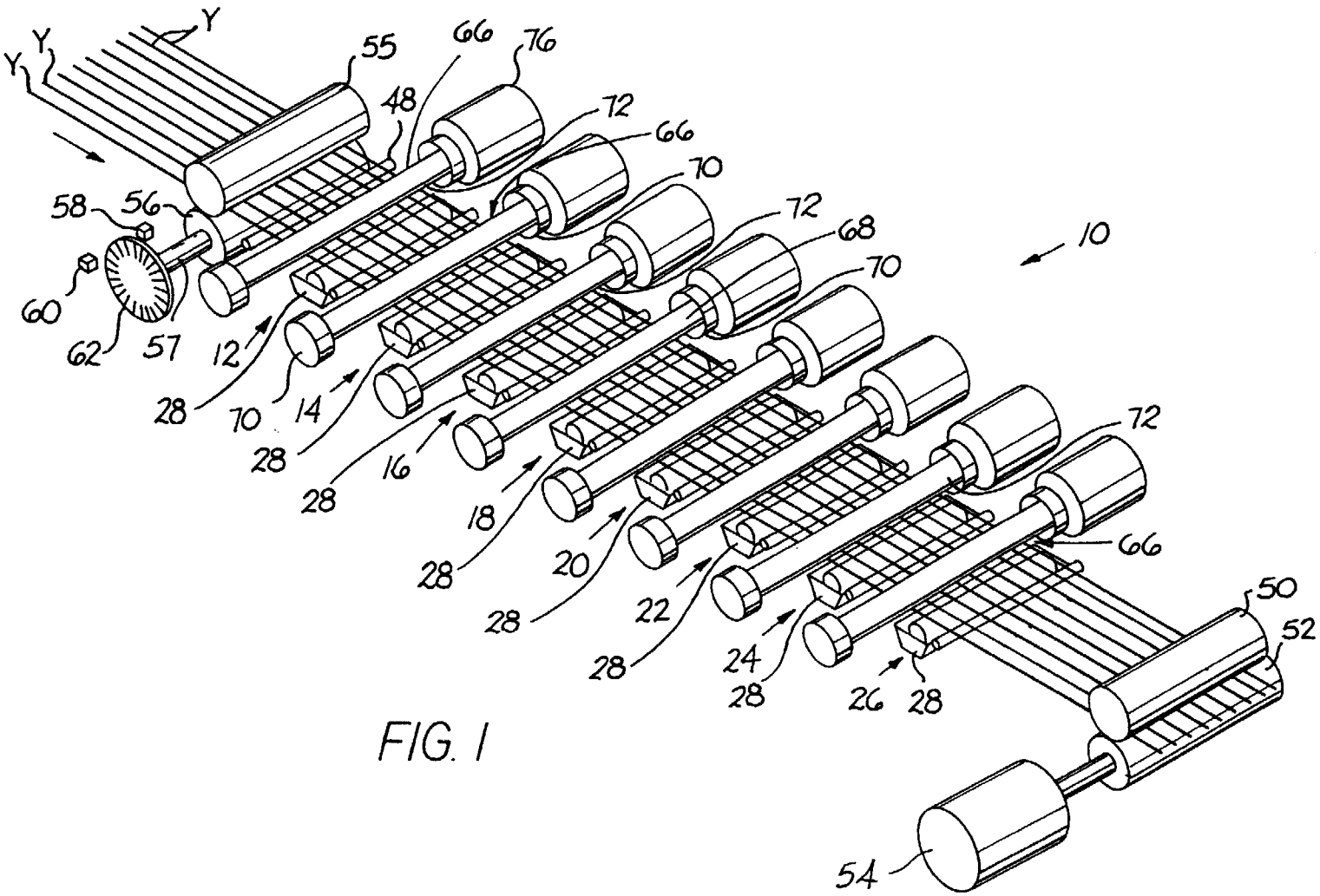
FIG. 1 is a diagrammatic perspective view of an eight station space dyeing apparatus constructed in accordance with the present invention.
Figure 2:
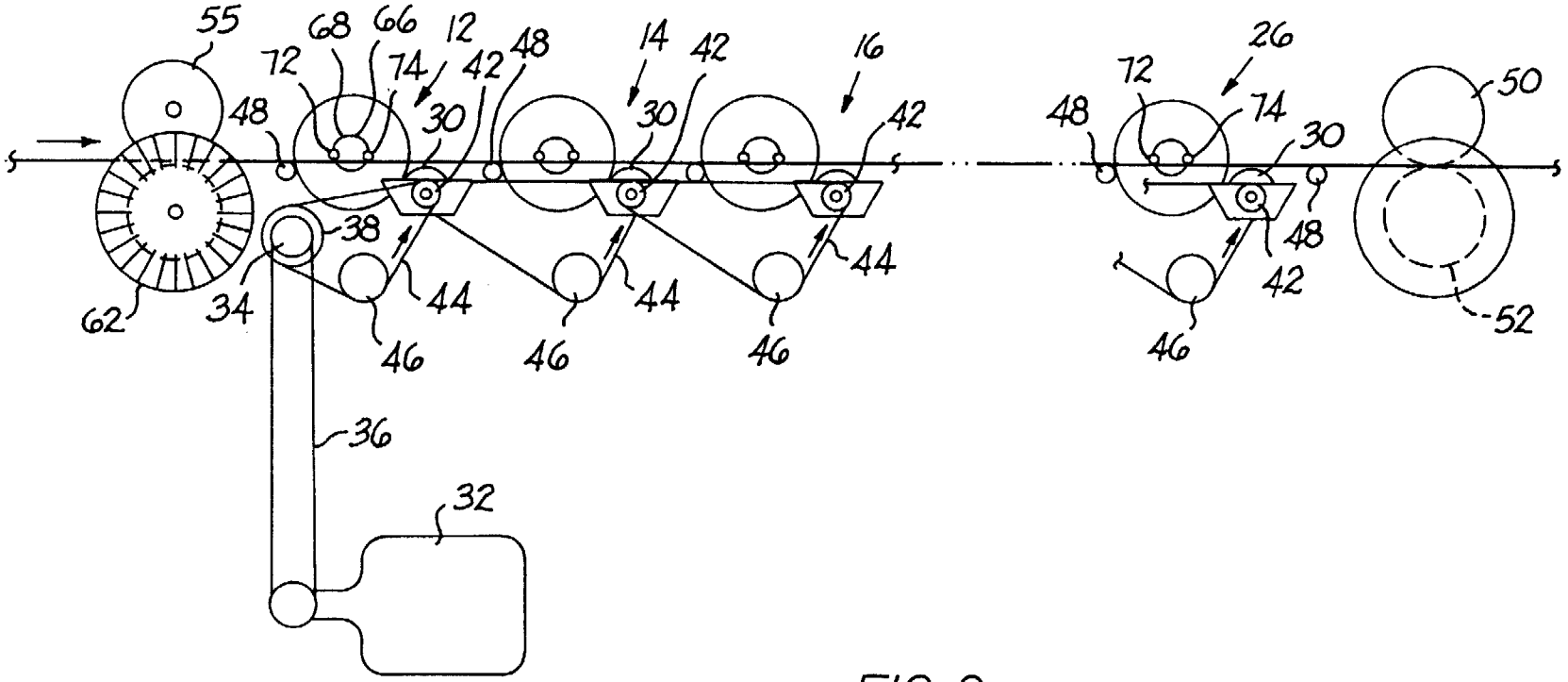
FIG. 2 is a diagrammatic side elevational view of the apparatus illustrated in FIG. 1.

Referring to the drawings, and in particular to FIGS. 1 and 2, dyeing apparatus 10 constructed in accordance with the preferred form of the present invention essentially includes apparatus such as that disclosed in the aforesaid Haselwander patents, the disclosure of which is incorporated herein by reference thereto. Thus, the apparatus includes a plurality of dye stations and although the number of such stations may vary as the number of colors desired, in the preferred embodiment there are eight dye stations designated in FIG. 1 as 12, 14, 16, 18, 20, 22, 24 and 26, each dye station comprising a respective dye pan 28 within which a respective dye color in a liquid state is located. Rotatably mounted within each dye pan 28 is a respective dye applicator roll 30 preferably constructed from or at least having a circumference comprising stainless steel. Although not illustrated in FIG. 1 for purposes of clarity of presentation, FIG. 2 illustrates that the dye applicator rolls 30 are driven in unison by a common drive including a variable speed motor 32, which may be a motor connected to a variable speed drive, and which preferably is coupled to a pulley 34 for driving the same. A timing belt 36 is trained about the pulley 34 and another pulley 38 which may be a compound pulley having two pulley elements or may be mounted on a common shaft with the pulley 34. At each station the axle on which the dye applicator roll is mounted sealably extends out ends of the respective pans 28 and has a pulley 42 mounted thereon. A timing belt 44 is trained about the pulley 38, an idler pulley 46 and the pulley 42 at one side of the dye applicator roll of the first station 12 so as to drive the first station dye applicator roll. A similar timing belt 44 is trained about the pulley 42 at the opposite side of the first station applicator roll, a second idler pulley intermediate the first and second station dye pans and the pulley mounted on the dye applicator roll at the corresponding side of the second station 14 so as to drive the second station dye applicator roll. Each dye applicator roll is driven in a similar manner from an adjacent roll, the dye applicator roll at the last station 26 of course only requiring a single pulley at the driven side. For a complete description of the details of the dye applicator drive system, reference may be had to the aforesaid Haselwander patents.

A plurality of yarn strands Y are fed over a series of yarn support members 48, there being one behind each dye applicator roll 30 and in front of the first dye applicator roll. The yarn is fed by means of feed rollers 50, 52 or the like downstream of the last dye station 26 so as to pull the yarn through the stations, the rollers being driven by a variable speed drive motor 54 which permits the yarn Y to be fed at selected speeds. It is expected that a feed rate of approximately 1500 feet per minute may be ideal. In order to apply appropriate tension to the yarn strands, tension rolls 55, 56 are disposed upstream of the first dye station 12. For reasons which will hereinafter become clear, an optical encoder is mounted on the shaft of one of the tension rolls, such as shaft 57 of roll 56, the encoder may comprise an electronic device or may be of the type comprising a light source such as a light emitting diode 58, a photocell 60 and a slotted disk 62 between the light source and the photocell. The encoder may be mounted on the shaft of the motor 54 if desired, although from an accuracy standpoint the upstream position may be preferred. The disk of the encoder follows the rotation of the roll and transmits electrical signals in the form of pulses to a controller 64 illustrated in FIG. 5 to which further reference hereinafter will be made.

Positioned at each dye station above and offset relative to each dye applicator roll is a pattern roll 66 which comprises a shaft 68 having an end cap 70 at each end, the end cap comprising a flange for receiving the ends of a plurality of deflecting paddles each in the form of a rod 72, 74, and a plate, one plate acting to position the rods and the other acting for removably locking the rods in place. In accordance with the preferred embodiment of the invention, each pattern roll comprises two rods, i.e., a pair of rods spaced apart by 180° so as to balance the rotational forces. However, more than one pair of rods may be utilized such as four rods with the rods being spaced at 90° intervals, or six rods with the rods being spaced 60° apart.

In the aforesaid Haselwander patents, the pattern rolls are rotated continuously in unison and the deflecting paddles are positioned in selected circumferential locations in order to provide selective patterning which, although the pattern could be changed by relocating the paddles, the length of each of the color spots formed by each pattern roll was fixed during a run and the length of yarn before a pattern was repeated was limited to approximately 150 inches. However, as there disclosed, when a paddle engages the yarn strands the yarn strands are deflected by the paddles in seriatim out of the normal path of the dye applicator rolls as the yarn is fed over the yarn support members and into engagement with the respective cooperating dye applicator roll to receive dye.

Figure 3:
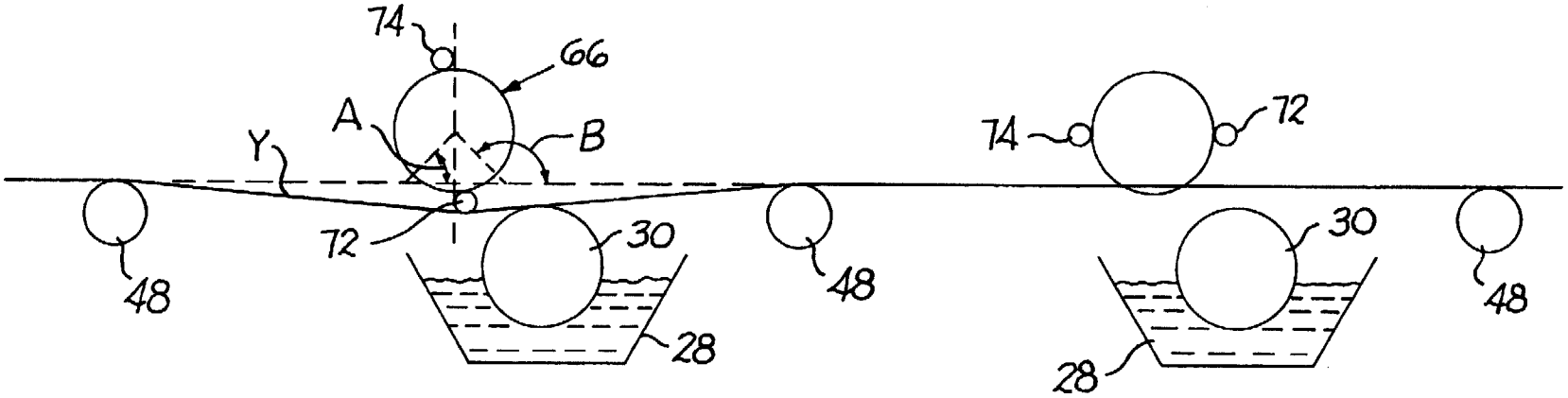
FIG. 3 is a fragmentary diagrammatic view depicting the movement of yarn through two stations of the apparatus and the action of the associated pattern rolls.

However, in accordance with the present invention, each of the pattern rolls is coupled to a respective servo motor 76 which likewise may be a stepper motor or other motor which moves a prescribed angular distance or to a prescribed angular location upon command. As illustrated in FIG. 3, when one of the deflecting rods 72, 74 engages and deflects the yarn Y at any of the dyeing stations, the dye shortly thereafter is moved into contact with the corresponding dye applicator roll 30. Although the pattern roll 66 must be positioned such that the deflecting rods engage the yarn at least at one position, which would be when the deflecting rod is 90° to the undeflected disposition of the yarn, it is preferred that each deflecting rod initially engage the yarn slightly before 45° to the undeflected disposition of the yarn relative to the direction from which the yarn is fed so that when engaged at 45°, the yarn contacts the dye applicator roll and the rod ceases engagement slightly after 45° to to the undeflected disposition of the yarn relative to the direction in which the yarn is moving so that at such 45° upstream angle the yarn ceases engagement with the dye applicator roll. Thus, assuming yarn is fed from the left in FIG. 3, and that the pattern roll 66 is upstream of the dye applicator roll 30 and rotating counter clockwise, i.e., effectively moving in the same direction as the yarn, each rod 72, 74, may initially engage the yarn substantially when the rod is at an angle A of 45° relative to the undeflected yarn as illustrated in FIG. 3 and ceases such engagement substantially when the angle B is 135°. Thus, dyeing starts when the rod is disposed at substantially 45° and will stop dyeing when the rod is substantially 135°. This is further illustrated by the graphical depiction entitled "Yarn Deflection" at the left side of FIG. 4 which shows that when a rod is disposed at a position between substantially 45° and 135°, the yarn is deflected as the length of yarn between the guide rods 48 is increased and dyeing occurs. The right side of FIG. 4 also illustrates that when a rod is held between these positions, such as at 90° to the undeflected disposition of the yarn for a period of time, dyeing occurs for a longer period of time.

Figure 4:
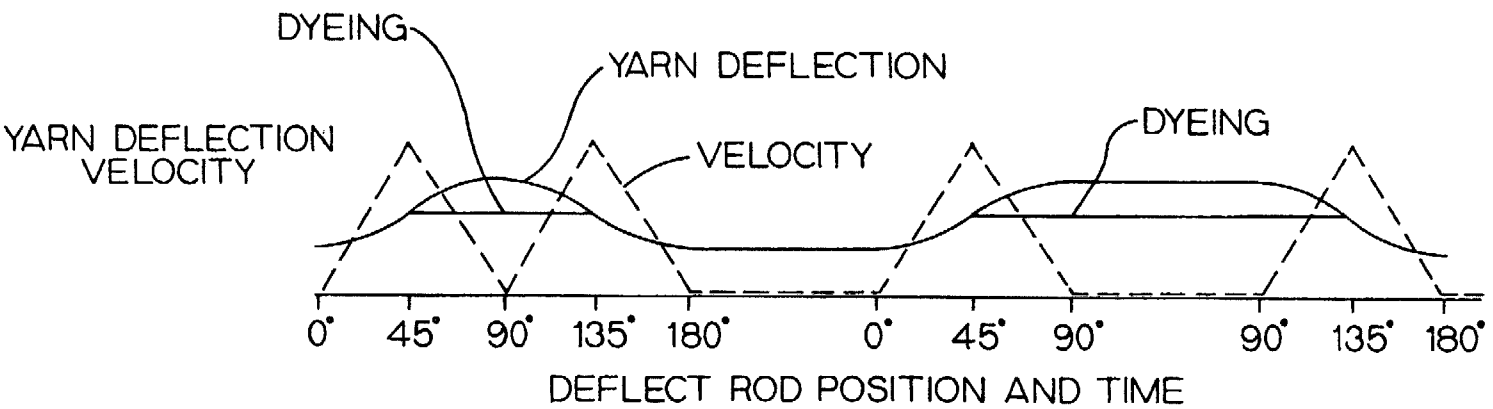
FIG. 4 is a graphical depiction of the pattern roll paddle or deflecting rod position for a two paddle roll at one dye station during movement of the yarn strands through that station and a graphical representation superimposed thereon illustrating the velocity of the pattern roll.

As aforesaid, the yarn is constantly being fed through the stations so that by selectively positioning a pattern roll rod between the initial deflection or dye starting angle and the final deflection or dye stopping angle and holding the rod in that range for selected time periods, the amount of dye at each station may be controllably applied to the yarn, i.e., the length of each dye spot or color may be controllably selected by instructing each of the respective servo motors 76 to rotate to the position where deflection of yarn by a rod results in commencing of dyeing when the yarn has moved to the disposition of the selected station and when dyeing is to cease, the respective servo motor is instructed to move to the position where the deflecting rods of the pattern roll associated with that servo motor no longer deflect the yarn. For example, in the preferred embodiment wherein each pattern roll has two deflecting rods, the servo motor is instructed to move the rods to the 45° position relative to the undeflected yarn to start dyeing by deflecting the yarn and to move from that position to the 135° position to stop the dyeing by no longer deflecting the yarn. Preferably, so that the dyeing of colors do not overrun, starting and stopping of dye should be crisp so that the rotational velocity of the respective pattern rolls 66 should be at a maximum when dyeing starts and stops. As illustrated in FIG. 4, this velocity is a maximum at the 45° angle and 135° angle positions and is reduced to zero when the appropriate deflecting rod is disposed at 90° to the undeflected disposition of the yarn. If an elongated spot of a color is to be dyed, the pattern roll may be stopped and rests at the 90° position at zero velocity as illustrated at the right side portion of FIG. 4. There, for example, the length of yarn dyed with that color may be twice that illustrated in the left side of FIG. 4.

Figure 5:
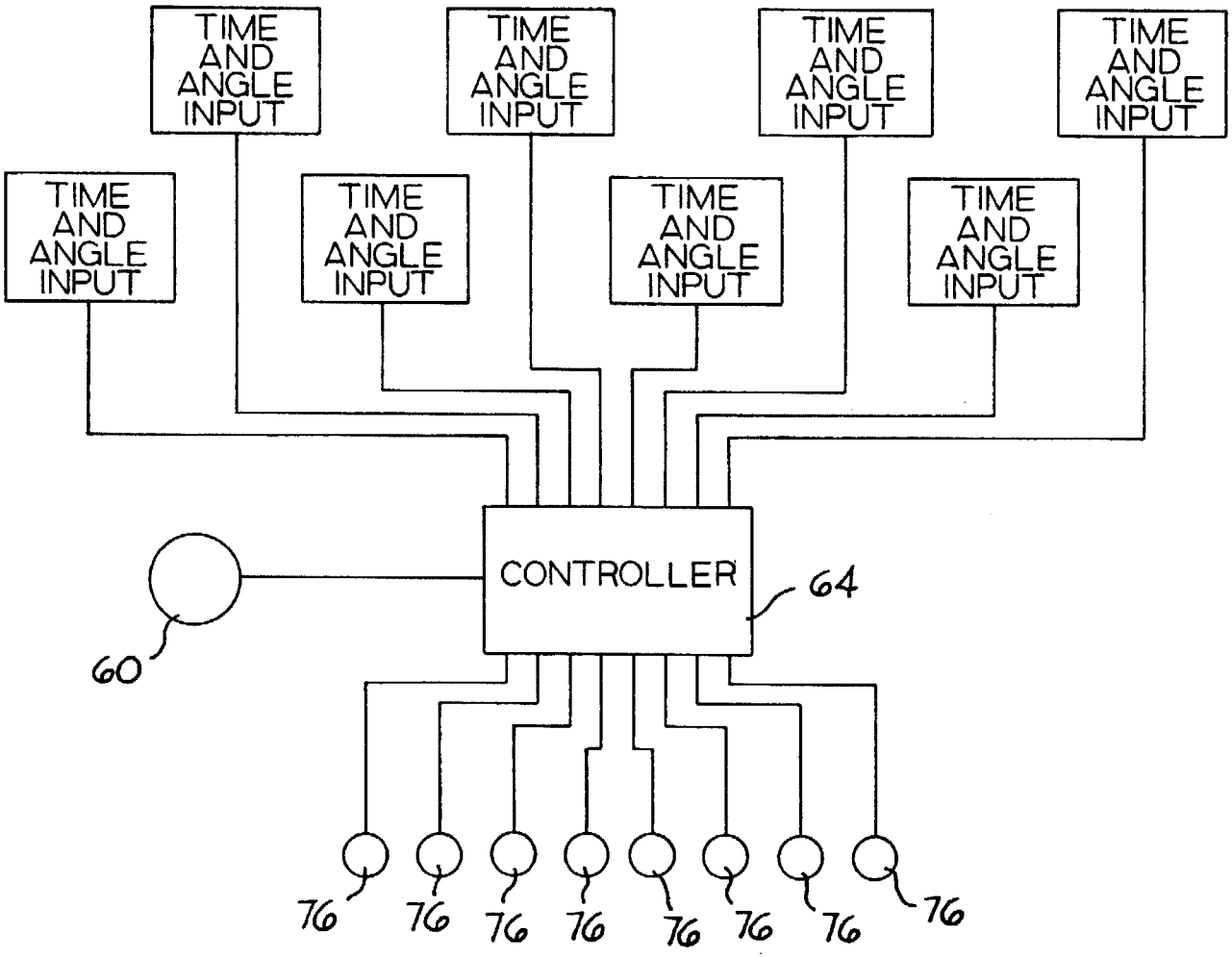
FIG. 5 is an electrical flow diagram for the operation of the pattern rolls of the space dyeing apparatus illustrated in FIG. 1.

The controller 64, as illustrated in FIG. 5, is an eight channel programmable industrial controller, one channel being connected to a respective one of the servo motors 76. As aforesaid there is one servo motor 76 at each of the dyeing stations. The controller receives a programmed input of the angle at which each servo motor must be positioned to start and stop dyeing in regard to the location of the yarn through the system, i.e., the time the yarn is at a particular station. This information is then directed to the respective channel. Thus, at any particular time the yarn will be at a given dye station and when the yarn is at a disposition such that dyeing should start, the corresponding stepper motor will be instructed to be at a position such that one of its deflecting rods 72, 74 will be at the 45° position. Likewise, when the yarn has reached a position wherein dyeing should terminate at that station, the servo motor is instructed to be at the 135° disposition. The servo motor may be stopped intermediate the dye starting and stopping positions, especially for longer lengths of dyeing of a color at the particular station. When dyeing at a station is not occurring, the corresponding servo motor 76 will position the rods 72, 74 at a disposition such as illustrated at the right side in FIG. 3, e.g., about 180°. As illustrated in FIG. 4 at this position the velocity of the pattern roll is zero and yarn is not being deflected toward the dye applicator roll 30. Timing of the signals from the controller 64 to each of the servo motors 76 is synchronized by the encoder signals transmitted by the photocell 60 to the controller. Thus, the signals from the encoder clock the controller to ensure that the output signals are received by the respective servo motor in timed relationship with the movement of the yarn through the respective dyeing system.

The controller 64 is a conventional microprocessor-based programmable industrial controller such as those marketed by Giddings & Lewis of Fond Du Lac, Wisc., U.S.A. under the trademark PIC900. This controller provides motion control of servo motors and drives in a simple manner such that it is readily usable with the space dyeing system of the present invention. A RAM (random access memory) disk stores data for the pattern selection. At each instant of time, which as aforesaid is directly related to the position of the yarn, the controller instructs each servo motor drive to locate the servo motor and thus the pattern roll at a specific angular disposition and the position of the servo system is fed back to the controller to ensure proper response.

The information input to the controller 64 comprises time and angle information calculated to determine the time a pattern roller yarn deflecting rod 72, 74 must be moved to the 45° position to engage and deflect yarn to commence and start dyeing a particular color at the correct place and when disengage the yarn to cease deflection and stop the dyeing. These calculations are based on the geometry of the system, including the diameter of the dye applicator rolls 30, the pattern rolls 66, the guide rods 48 and the spacing between these elements, together with the selected yarn feed and the undeflected yarn length between the guide rods, the latter being 5 inches in a prototype, as is also the distance between the dye applicator rolls and also the pattern rolls between adjacent dye stations in the preferred mode of the invention. The color pattern, tray selection for each color, the wicking action of each dye/yarn combination, i.e., wicking factor, and the dye characteristics, such as elongation or stretch, coefficient of friction and initial dye tension are selected or determined. The color pattern may, for example, begin with 8 inches of red, 3 inches of blue, 4 inches of green, another 3 inches of red, 5 inches of brown, 6 inches of yellow and so on for an entire repeat as desired by a carpet stylist. The wicking factor, which may be established by an actual length measurement after a trial run or may be an experience factor, will require subtracting an amount from the length of a color spot used in the calculations so as to obtain the desired length. If desired, overlap of colors may also be included.

From this information, the yarn length between each pair of guide rods 48 and the bending angle of the yarn when deflected at different dispositions of the deflecting rods 72, 74 relative to the undeflected length and position of the yarn is first readily determined for one cycle at selected fine time intervals for one pattern roll cycle. From the selected pattern, i.e., the length of each color throughout the pattern, the starting point on the yarn at which dyeing of a particular color is to occur is tabulated by adding up all preceding color spots. For example, with a color pattern as indicated above, the first red color will start at zero inches, blue will start at 8 inches, green will start at 11inches, the second red will start at 15 inches, etc. Thus, the starting point in inches on the yarn for each color spot is tabulated. It may be mentioned at this point that since the calculations may be tedious, especially where the system has a number of stations, such as the eight stations disclosed herein, these calculations preferably are carried out by a conventional spread sheet program. Each dye starting position of the same color is coordinated or sorted out and assigned to the selected tray. If a wicking factor is used, it is added to the starting position and subtracted from the ending position so that dyeing is delayed by the amount of the wicking factor and is terminated short by the amount of the wicking factor. The wicking factor being the result of dye drawn past the beginning and end of a dye spot due to capillary action and thereby providing a greater length of dye spot at the dye spot location.

The time at which each color start and stop occurs for the first tray is then determined from the yarn speed and the location on the yarn at which each color is to start. The information from the yarn length and bending angle at selected time intervals is then combined with the time of color start and color stop to correlate the time of color start and stop with the location of the pattern roll deflecting rods so that one of the deflecting rods engages yarn to create the initial angle at which yarn is deflected against the dye applicator roll at a particular time, and the final angle when the yarn is no longer engaged. The pattern roll is driven by the respective servo motor, preferably at speeds varying as depicted in FIG. 4, so that the pattern roll deflecting rods contact the yarn for a period of time while the angle of the yarn is changing relative to the undeflected position. The pattern roll is stopped either instantaneously or for a period of time dependent upon the length of the dye color to be applied to the yarn as indicated in FIG. 4 and is then restarted so that dyeing occurs until the rod 72, 74 moves to a point where the angle, e.g., 135°, that the yarn makes relative to its undeflected length is so small that dyeing ceases at a time when the length of yarn dyed with this color is that which corresponds to the desired length of the dye spot.

When the calculations for stations after the first station are made, the time at which each color start occurs is determined in the same manner as for the first station, however, the time delay as a result of the yarn having to travel to the next station must be taken into account. It may be noted that when the yarn is deflected by an upstream pattern roll rod, the yarn is slowed to the downstream stations since the yarn path is longer. Thus, the start of dyeing at the downstream stations is delayed. Thus, the delay at the second station is calculated by first adding the yarn length between the first and second stations and the yarn stretch, which is calculated from the bending angle, the friction coefficient and the stretch factor of the yarn. This total length is divided by the yarn speed in order to obtain the time delay at the second station. The calculation is repeated at sufficiently short time intervals for as long as it takes to run one color pattern. This time delay is used to update or modify the times at which each color start at the second station occurs, i.e., the time at which the bending angle must be such that the deflection rods deflect the yarn fed between stations 12 and 14 so that the second dye color is applied to the yarn. The time at which each color stop occurs is determined from the yarn length and bending angle to provide the time at which dyeing ceases at the second station. Between these times, the second pattern roll stops or rotates very slowly so that the yarn continues to be dyed with the dye in the second tank 28. The time, length and bending angle for the remaining stations are determined in a similar manner.

The time for color start and color stop for each station for an entire pattern repeat is tabulated together with the angle of the respective servo motor, i.e., the time and position of the starting and stopping of each servo motor. These times and positions of start and stop are input to the controller 64 for driving the servo motors. As aforesaid, with the two deflecting rod pattern roll, starting and stopping of dyeing may be selected to occur at 45° and 135° relative to the undeflected yarn.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for space dyeing yarn comprising, a plurality of spaced apart dyeing stations, means for feeding said yarn through said stations in seriatim in one direction, each dyeing station having dye applying means for applying dye of a selected color onto said yarn, a rotatable pattern member disposed at each dyeing station for selectively permitting and preventing dye to be applied to said yarn by the respective dye applying means, a motor for rotating each pattern member selectively, and control means for selectively starting and stopping rotation of each motor in timed relationship with the movement of the yarn in accordance with a pattern to move the pattern member associated therewith to positions which permit and prevent dyeing at each station, whereby dye of the selected colors may be applied to selective lengths of said yarn at each station.

2. Apparatus as recited in claim 1, wherein said control means includes means for providing a signal representative of the speed at which yarn is being fed, and means for starting and stopping rotation of each motor at times responsive to said signal.

3. Apparatus as recited in claim 1, wherein each pattern member comprises yarn deflecting means for deflecting said yarn into contact with said dye applying means.

4. Apparatus as recited in claim 1, wherein each of said dye applying means comprises a dye applicator roll having a peripheral surface, a dye pan containing a liquid dye corresponding to each roll, and means for rotatably mounting each roll about a respective axis of rotation with at least a portion of the peripheral surface in a respective dye pan and with the peripheral surface disposed for contacting said yarn.

5. Apparatus as recited in claim 4, including support means for supporting said yarn above said peripheral surface as the yarn is being fed, and each pattern member comprises yarn deflecting means for deflecting said yarn into contact with the periphery of a respective dye applicator roll.

6. Apparatus as recited in claim 5, wherein said control means includes means for providing a signal representative of the speed at which yarn is being fed, and means for starting and stopping rotation of each motor at times responsive to said signal.

7. In the method of space dyeing moving yarn by apparatus having a plurality of rotatable pattern members, each pattern member permitting a dye to be applied to the yarn in seriatim only when disposed in a selected angular disposition relative to said yarn, each pattern member being associated with a different color dye, the improvement comprising varying the speed of each member to control the angle through which each of the members rotates during repetitive time periods so that the disposition required to permit dyeing of yarn by each color may be obtained at selected times, and coordinating the location along the yarn at which each member permits dye to be applied, whereby each different color dye may be applied along different amounts of the yarn and at selected locations.

8. In the method recited in claim 7, wherein each pattern member is rotatably driven by a respective motor, and said method includes rotating each motor to prescribed angular dispositions at specific times.

9. In the method as recited in claim 8, including obtaining a signal related to the speed of movement of said yarn, and controlling the rotation of each motor in the response to said signal.

10. In the method as recited in claim 7, wherein the commencement of dyeing for each color is delayed for a time to provide a lesser amount of dye on the yarn equal to a wicking factor corresponding to each color, and wherein the termination of dyeing for each color is terminated earlier for each color by the wicking factor.

11. A method of space dyeing yarn at a plurality of spaced apart dye stations, comprising feeding said yarn in one direction through said stations, locating a dye applying means at each station for applying dye of a selected color onto said yarn, locating a rotatable pattern member at each station for selectively permitting and preventing dye to be applied to said yarn by the respective dye applying means, and controllably rotating each pattern member independently of the other pattern members in accordance with a pattern to selected positions to permit dye to be applied to said yarn at selected times and to prevent dye to be applied to the yarn at other times.

12. The method as recited in claim 11, wherein said controllably rotating each pattern member comprises starting and stopping the respective pattern member in accordance with a pattern in timed relationship to the feeding of said yarn.

* * * * *